US010414057B2

(12) United States Patent
Ntavos et al.

(10) Patent No.: US 10,414,057 B2
(45) Date of Patent: Sep. 17, 2019

(54) SHAVING BLADE CARTRIDGE

(71) Applicant: BIC-VIOLEX SA, Anixi, Attiki (GR)

(72) Inventors: Vasileios Ntavos, Ilion (GR); Georgios Georgakis, Melisia (GR); Ioannis Bagourdas, Neo Psychiko (GR); Phaedon Papageorgis-Papadopoulos, Holargos (GR)

(73) Assignee: BIC-VIOLEX SA, Anixi (GR)

( * ) Notice: Subject to any disclaimer, the term of this patent is extended or adjusted under 35 U.S.C. 154(b) by 260 days.

(21) Appl. No.: 15/106,369

(22) PCT Filed: Dec. 18, 2013

(86) PCT No.: PCT/EP2013/077172

§ 371 (c)(1),
(2) Date: Jun. 20, 2016

(87) PCT Pub. No.: WO2015/090385

PCT Pub. Date: Jun. 25, 2015

(65) Prior Publication Data

US 2017/0028577 A1 Feb. 2, 2017

(51) Int. Cl.
*B26B 21/40* (2006.01)
*B26B 21/22* (2006.01)
*B26B 21/44* (2006.01)

(52) U.S. Cl.
CPC ..... *B26B 21/4012* (2013.01); *B26B 21/227* (2013.01); *B26B 21/4068* (2013.01); *B26B 21/443* (2013.01)

(58) Field of Classification Search
CPC ..... B26B 21/00; B26B 21/40; B26B 21/4006; B26B 21/4012; B26B 21/4018; B26B 21/4025; B26B 21/4031; B26B 21/4037
(Continued)

(56) References Cited

U.S. PATENT DOCUMENTS 3,412,464 A * 11/1968 Keck ..... B26B 21/00 30/40
3,935,639 A * 2/1976 Terry ..... B26B 21/225 30/47

(Continued)

FOREIGN PATENT DOCUMENTS

WO WO 97/17174 5/1997
WO WO 97/35693 10/1997

(Continued)

OTHER PUBLICATIONS

International Search Report of PCT/EP2013/077172 dated Aug. 28, 2014.

*Primary Examiner* — Jason Daniel Prone
*Assistant Examiner* — Richard D Crosby, Jr.
(74) *Attorney, Agent, or Firm* — Polsinelli, PC

(57) ABSTRACT

A shaving blade cartridge includes a housing extending along a longitudinal axis. The housing has a top side, a bottom side opposite to the top side, and two longitudinal sides extending along the longitudinal axis between the top and bottom sides. The shaving blade cartridge also includes a cutting blade mounted in the housing between the longitudinal sides and having a cutting edge extending along the longitudinal axis, and a retainer retaining the cutting blade in the housing. The retainer is retained on the housing by a rivet. A method for the manufacture of shaving blade cartridges and a razor having such shaving blade cartridge are also provided.

17 Claims, 5 Drawing Sheets

(58) Field of Classification Search
USPC ..... 30/47–51
See application file for complete search history.

(56) References Cited

U.S. PATENT DOCUMENTS 4,063,354 A 12/1977 Oldroyd et al.
4,069,580 A * 1/1978 Cartwright ..... B26B 21/4012 30/47
4,094,063 A * 6/1978 Trotta ..... B26B 21/521 30/47
4,270,268 A * 6/1981 Jacobson ..... B26B 21/227 30/47
4,288,920 A * 9/1981 Douglass ..... B26B 21/521 30/47
4,337,575 A * 7/1982 Trotta ..... B26B 21/227 30/47
4,403,412 A * 9/1983 Trotta ..... B26B 21/227 30/47
4,443,939 A * 4/1984 Motta ..... B26B 21/4012 30/49
4,443,940 A 4/1984 Francis et al.
4,516,320 A * 5/1985 Peleckis ..... B26B 21/4018 30/49
4,574,476 A * 3/1986 Ortiz ..... B26B 21/227 30/47
4,587,729 A * 5/1986 Jacobson ..... B26B 21/225 30/41
4,754,548 A * 7/1988 Solow ..... B26B 21/4006 30/32
4,854,043 A * 8/1989 Chen ..... B26B 21/4012 30/32
4,901,437 A * 2/1990 Iten ..... B26B 21/14 30/50
4,932,122 A * 6/1990 Shurland ..... B26B 21/222 30/346.5
4,980,974 A * 1/1991 Radcliffe ..... B26B 21/22 30/356
5,003,694 A * 4/1991 Chen ..... B26B 21/4012 30/32
5,092,042 A * 3/1992 Miller ..... B26B 21/4031 30/34.2
5,199,173 A * 4/1993 Hegennann ..... B26B 21/165 30/49
5,224,267 A * 7/1993 Simms ..... B26B 21/4068 30/50
5,313,706 A * 5/1994 Motta ..... B26B 21/227 30/47
5,341,571 A * 8/1994 Prochaska ..... B26B 21/22 30/47
5,347,714 A * 9/1994 Prochaska ..... B26B 21/227 30/32
5,377,409 A * 1/1995 Chen ..... B26B 21/4012 30/41
5,493,778 A * 2/1996 Ichiyanagi ..... B26B 21/4006 30/41
5,501,014 A * 3/1996 Hegemann ..... B26B 21/222 30/346.5
5,526,567 A * 6/1996 Carson, III ..... B26B 21/222 30/346.58
5,551,153 A * 9/1996 Simms ..... B26B 21/227 30/346.59
5,557,851 A * 9/1996 Ortiz ..... B26B 21/227 30/48
5,590,468 A * 1/1997 Prochaska ..... B26B 21/22 30/41
5,715,606 A * 2/1998 de Wolf ..... B26B 21/227 30/346.5
5,761,814 A * 6/1998 Anderson ..... B26B 21/4068 30/50
5,794,343 A * 8/1998 Lee ..... B26B 21/4012 30/50
5,813,293 A * 9/1998 Apprille, Jr. ..... B26B 21/225 76/106
5,822,862 A * 10/1998 Ferraro ..... B26B 21/227 30/50
6,035,537 A * 3/2000 Apprille, Jr. ..... B26B 21/227 30/346.5
6,185,822 B1 * 2/2001 Tseng ..... B26B 21/443 30/41
6,397,473 B1 * 6/2002 Clark ..... B26B 21/227 30/50
6,880,253 B1 * 4/2005 Gyllerstrom ..... B26B 21/14 30/50
6,944,952 B1 * 9/2005 Tseng ..... B26B 21/4087 116/208
D514,253 S * 1/2006 Gray ..... D28/47
7,100,284 B2 * 9/2006 King ..... B26B 21/225 30/49
7,370,419 B2 * 5/2008 Coffin ..... B26B 21/227 30/41
7,607,230 B2 * 10/2009 Aviza ..... B26B 21/4068 30/50
7,992,304 B2 * 8/2011 Nakasuka ..... B26B 21/227 30/50
D648,075 S * 11/2011 Wonderley ..... D28/47
8,046,920 B2 * 11/2011 Nakasuka ..... B26B 21/227 30/50
8,061,039 B2 * 11/2011 Kwiecien ..... B26B 21/443 30/41
8,359,752 B2 * 1/2013 Bridges ..... B26B 21/222 30/50
8,448,339 B2 * 5/2013 Walker, Jr. ..... B26B 21/4031 30/47
8,689,448 B2 * 4/2014 Ren ..... B26B 21/4012 30/34.1
8,931,176 B2 * 1/2015 Johnson ..... B26B 21/4018 30/34.2
D731,708 S * 6/2015 Tucker ..... D28/47
9,415,522 B2 * 8/2016 Oglesby ..... B26B 21/4031
9,539,734 B1 * 1/2017 Bozikis ..... B26B 21/227
9,630,330 B2 * 4/2017 Ntavos ..... B26B 21/222
9,630,332 B2 * 4/2017 Coresh ..... B26B 21/38
9,821,480 B2 * 11/2017 Coresh ..... B26B 21/225
9,937,630 B2 * 4/2018 Georgakis ..... B26B 21/222
10,093,030 B2 * 10/2018 Efthimiadis ..... B26B 21/4012
10,093,031 B2 * 10/2018 Ren ..... B26B 21/443
2002/0144404 A1 * 10/2002 Gilder ..... B26B 21/22 30/50
2003/0208907 A1 * 11/2003 Brown, Jr. ..... B26B 21/222 30/50
2004/0118250 A1 * 6/2004 White ..... B26B 21/14 76/104.1
2005/0172489 A1 * 8/2005 Aviza ..... B26B 21/227 30/32
2005/0198840 A1 * 9/2005 Worrick, III ..... B26B 21/222 30/527
2006/0064875 A1 * 3/2006 Follo ..... B26B 21/225 30/34.1
2008/0196251 A1 * 8/2008 Royle ..... B26B 21/227 30/50
2015/0082638 A1 * 3/2015 Georgakis ..... B26B 21/222 30/77
2016/0332313 A1 * 11/2016 O'Connor ..... B26B 21/225
2016/0354940 A1 * 12/2016 Bozikis ..... B26B 21/227
2017/0028577 A1 * 2/2017 Ntavos ..... B26B 21/4012
2017/0043491 A1 * 2/2017 Griffin ..... B26B 21/4018
2017/0203451 A1 * 7/2017 Griffin ..... B26B 21/4031

FOREIGN PATENT DOCUMENTS

WO WO 99/16591 4/1999
WO WO 2005/090015 9/2005
WO WO 2005/090023 9/2005
WO WO 2005/108022 11/2005
WO WO 2012/158142 11/2012

* cited by examiner

SHAVING BLADE CARTRIDGE

This application is a national stage application of International Application No. PCT/EP2013/077172, filed on Dec. 18, 2013, the entire contents of which is incorporated herein by reference.

FIELD OF THE INVENTION

The embodiments of the present invention relate to shaving blade cartridges and shavers having such shaving blade cartridges.

BACKGROUND OF THE INVENTION

The embodiments of the present invention relate to a shaving blade cartridge that includes:

- a housing extending along a longitudinal axis, having a top side, a bottom side opposite to the top side, and two longitudinal sides extending along the longitudinal axis between the top and bottom sides,
- a cutting blade mounted in the housing between the longitudinal sides, and having a cutting edge extending along the longitudinal axis,
- a retainer retaining the cutting blade in the housing.

U.S. Pat. No. 4,443,940 describes a shaving blade cartridge that includes a housing and cutting blades. In a first embodiment of U.S. Pat. No. 4,443,940, a portion of the housing partly covers the cutting blades. This portion allows the cutting blades to be maintained on the housing. In another embodiment, the cutting blades are maintained by bridges which form a retainer. The retainer is integrally formed with a cap member and a partial guard member, and is then snap fitted in the housing. Such retainer is not secure and can reduce the blade security after the cartridge is assembled. Moreover, the manufacturing of such retainer can be long, and the assembly requires strict tolerances to be applied.

EP2123409 also describes a shaving blade cartridge having a housing and cutting blades. A snap fitted retainer is provided to retain the cutting blades on the housing. In order to provide a sufficient retention force, the retainer is snap fitted at many areas of the housing, and in particular a fixation is provided on the middle of the top side of the housing. However, such retainer reduces the active surface during the shaving.

The embodiments of the present invention have objectives to mitigate the drawbacks discussed above.

SUMMARY OF THE INVENTION

To this aim, according to an embodiment of the present invention, a shaving blade cartridge is characterized in that the retainer is retained on the housing by a rivet.

With these features, the housing and the retainers are robustly joined together. The rivet is resistant to fatigue, and in particular a rivet assembly is more resistant to fatigue than, for example, a welded assembly. The rivet is easy to set up, with low manufacturing costs. The rivet forms an unobtrusive and aesthetically pleasing fixation, which does not aggressively protrude from the housing.

In some embodiments of the present invention, a person of ordinary skill in the art might also use one or more of the following features:

- the retainer includes a retainer body extending on the top side of the housing, and the retainer and the housing are joined together on the top side of the housing; the manufacture is easy since the housing of the shaving blade cartridge does not have to be rotated to fix the retainer on the housing;
- the housing includes a riveting pin, the retainer includes a through hole, and the through hole cooperates with the riveting pin; the cooperation between the through hole and the riveting pin creates a position indicator for the retainer;
- the housing includes two riveting pins, the retainer includes two through holes, and each through hole cooperates with one of the two riveting pins, and wherein one of the two riveting pins is located in front of the cutting edge and the other of the two riveting pins is located rear of the cutting edge; the riveting pins which cooperate with the through holes allow an easy positioning of the retainer;
- the riveting pin includes a plastic material; the plastic material is easy to deform by riveting;
- the housing is provided with a guard bar, the guard bar being forward of the cutting edge;
- the riveting pin is provided adjacent to the guard; the position of the riveting pin allows a retention without lowering the shaving surface (which is the active surface during the shaving), and without lowering the shaving performances;
- wherein the housing includes a shaving aid member, the shaving aid member being rearward of the cutting edge;
- the riveting pin is provided adjacent to the shaving aid member; the position of the riveting pin does not lower the shaving performance;
- the riveting pin and the housing are integrally formed; the manufacture is easier and it provides an enhanced resistance;
- the retainer includes a retainer body extending along a transversal axis, the transversal axis being transverse to the longitudinal axis with two free end, the through hole being located toward one of the two free ends; this feature provides an aesthetical aspect and reduces the quantity of material to be used for the retainer;
- the riveting pin and the housing are in the same material; this feature enables an easy manufacture of the retainer;
- the retainer is flat; no further step for the forming of the retainer, such as bending, is needed; the tolerances can be increased;
- the housing has two recesses, the retainer includes two legs and a retainer body extending between the legs, the retainer body extending along a transversal axis, the transversal axis being transverse to the longitudinal axis, and the legs are each received in one of the two recesses; the free end of the retainer are hidden inside the housing;
- the two recesses extend along a lateral axis intersecting the transversal axis and the longitudinal axis, wherein the two recesses are blind holes, and wherein the two recesses are each located on either side of the cutting blade;
- the shaving blade cartridge includes two retainers retaining the blades in the housing, each of the two retainers and the housing are joined together by a rivet on the top side of the housing; the holding function is strengthened;
- the retainer body is provided with a groove; the cutting edge extends in the groove; this feature improves the control of the distance between two cutting blades to ensure the position and the localization of the cutting blade with regard to the housing, and to reduce a transversal motion of the cutting blade;

a plurality of cutting blades is provided, a plurality of grooves is provided, and each cutting blade cooperates with one groove provided on the interior surface of the retainer.

The embodiments of the present invention are also directed to a method for the manufacture of shaving blade cartridge that includes:

providing a housing extending along a longitudinal axis, the housing having a top side, a bottom side opposite to the top side and two longitudinal sides extending along the longitudinal axis between the top and bottom sides, a cutting blade being mounted in the housing between the longitudinal sides, the housing includes a riveting pin, and having a cutting edge extending along the longitudinal axis, providing a retainer with a through hole, assembling the retainer to the housing by placing the riveting pin in the through hole of the retainer, the riveting pin having a free end which protrudes from the through hole of the retainer, fixing the retainer on the housing by riveting, such that the retainer retains the cutting blade in the housing.

Such a method simplifies the manufacture of the shaving blade cartridge.

According to an embodiment of the present invention, the fixation of the retainer on the housing by riveting is made by plastic deformation of the free end of the riveting pin caused by punching. The fixation of the retainer on the housing by riveting could also be made by applying an ultrasonic beam to the riveting pin to deform the free end of the riveting pin. The ultrasonic welding method is easy to implement with, for example, a sonotrode.

The embodiments of the present invention are also directed to a shaver that includes a handle and a shaving blade cartridge as described above, the shaving blade cartridge being connected to the handle.

BRIEF DESCRIPTION OF THE DRAWINGS

Other characteristics and advantages of the embodiments of the present invention will readily appear from the following description of one of its embodiments, provided as non-limitative examples, and shown in the accompanying drawings.

On the different figures, the same reference signs designate like or similar elements.

DETAILED DESCRIPTION

FIGS. 1, 2, 4, 5A, and 5B show a shaving blade cartridge 1 of a wet razor 3 the blades 5 of which are not driven by a motor relative to the shaving blade cartridge 1.

Figure 11:
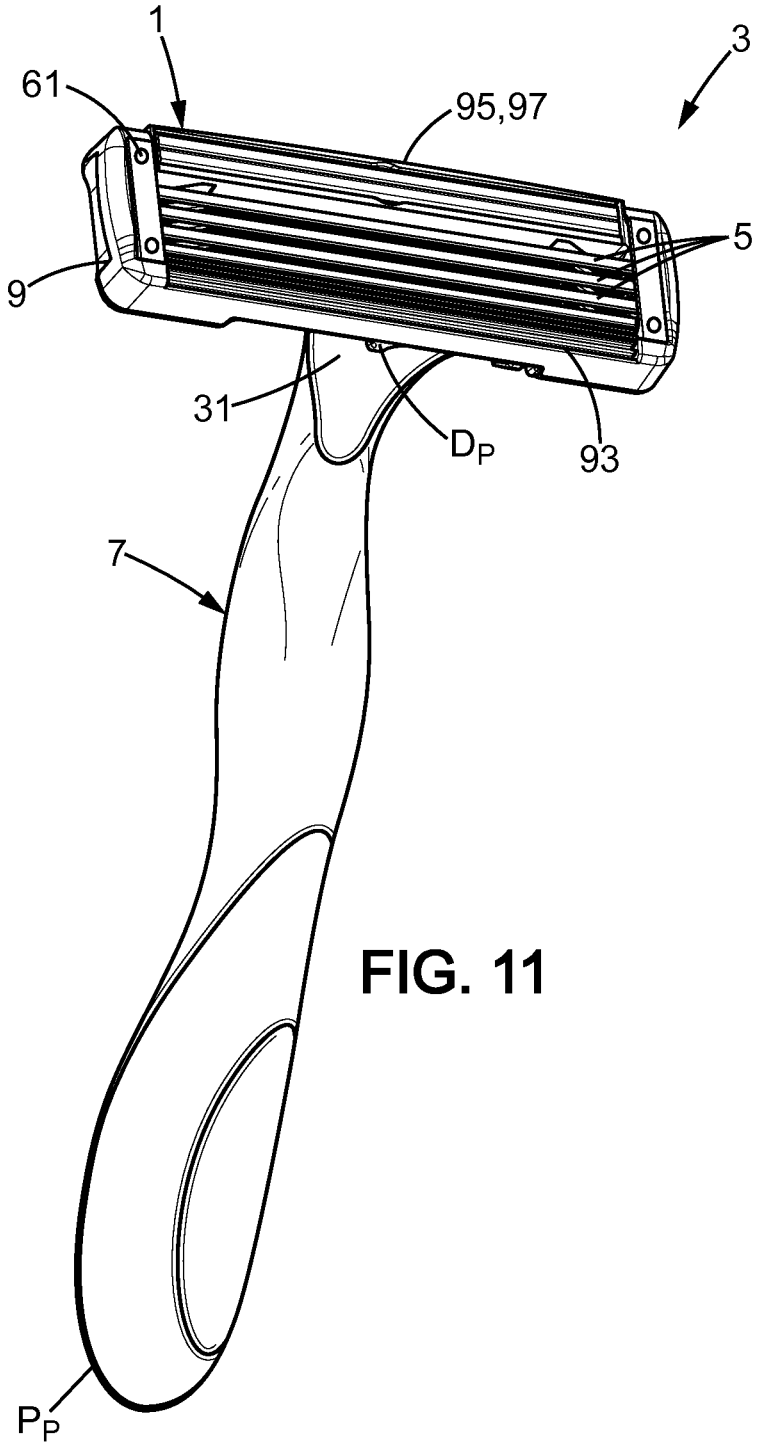
FIG. 11 shows a perspective view of a shaver that includes a handle and a shaving blade cartridge, according to the present invention.

As seen on FIG. 11, the shaving blade cartridge 1 can be attached to a handle 7 extending in a handle direction between a proximal portion Pp and a distal portion Dp. The handle 7 can pivot with regard to the shaving blade cartridge 1. In other embodiments of the present invention, the handle 7 may also be fixed with regard to the shaving blade cartridge 1. The handle direction may be curved or include one or several straight portions. The shaving blade cartridge 1 can, for example, be releasably connected to the shaver handle 7 through a lock-and-release mechanism.

As depicted on FIGS. 1, 2, 4, 5A, and 5B the shaving blade cartridge 1 includes a housing 9. The housing 9 extends along a longitudinal axis X-X. Viewed from the top, the housing 9 has a generally rectangular shape. However, in some embodiments of the present invention, the general shape of the housing 9 may be different; for example the housing 9 could have an oval shape, a square shape, or a circular shape. The housing 9 includes a top side 11, a bottom side 13 opposite to the top side 11 and a first and second longitudinal side 15, 17. For example, the bottom side 13 is adapted to be arranged proximate to the handle 7 whereas the top side 11 is arranged opposite to the bottom side 13. The top side 11 and the bottom side 13 can be parallel to each other.

The first longitudinal side 15 extends along the longitudinal axis X-X. The second longitudinal side 17 and the first longitudinal side 15 are facing each other. The second longitudinal side 17 may be approximately parallel to the first longitudinal side 15, especially when the first and second longitudinal sides 15, 17 are flat. However, the first and second longitudinal sides 15, 17 can also have subtle or noticeable opposing inclinations. The first and second longitudinal sides 15, 17 can also have curved surfaces. The second longitudinal side 17 also extends along the longitudinal axis X-X. The first and the second longitudinal sides 15, 17 each extend in a lateral direction Z along a lateral axis Z-Z, between the top side 11 and the bottom side 13 of the housing 9. The first side 15 can be forward or rearward of the blade edges according to different embodiments of the present invention. The lateral axis Z-Z intersects the longitudinal axis X-X. For example, the longitudinal axis X-X and the lateral axis Z-Z may be orthogonal to each other.

Figure 1:
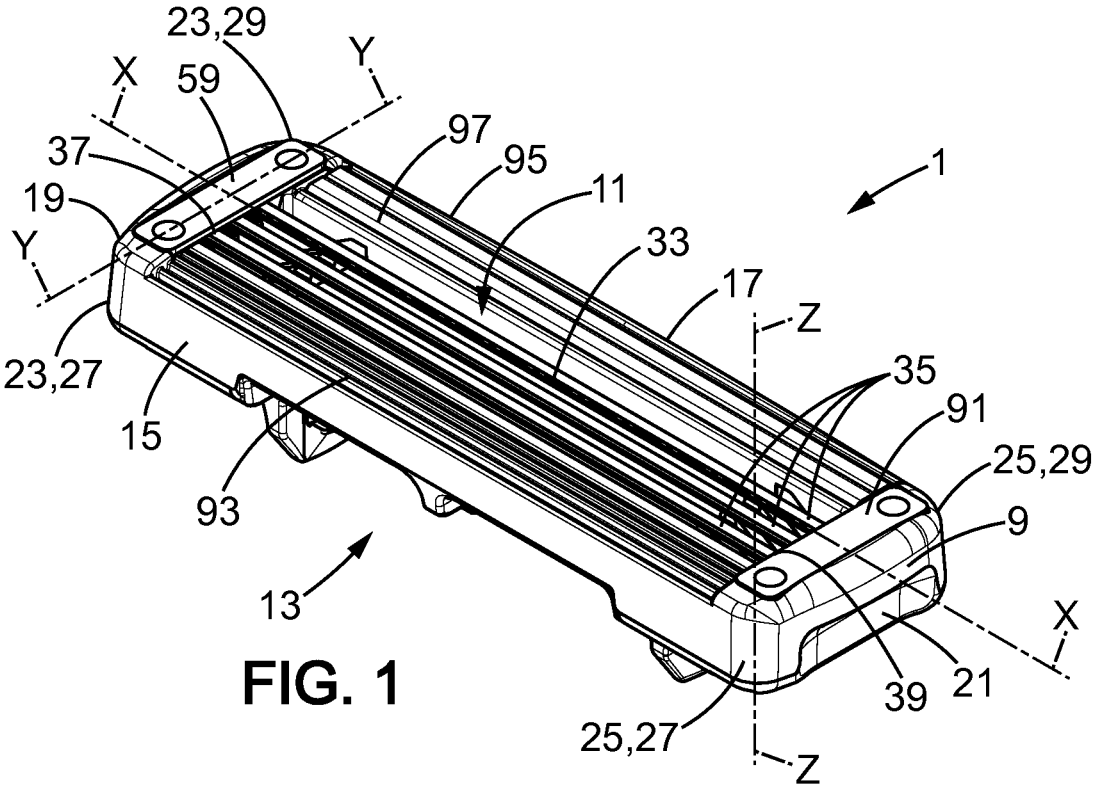
FIG. 1 is a perspective view of a shaving blade cartridge according to the present invention, the shaving blade cartridge includes a housing, three cutting blades and two retainers retaining the cutting blade in the housing, the shaving blade cartridge being in a mounted position.
Figure 2:
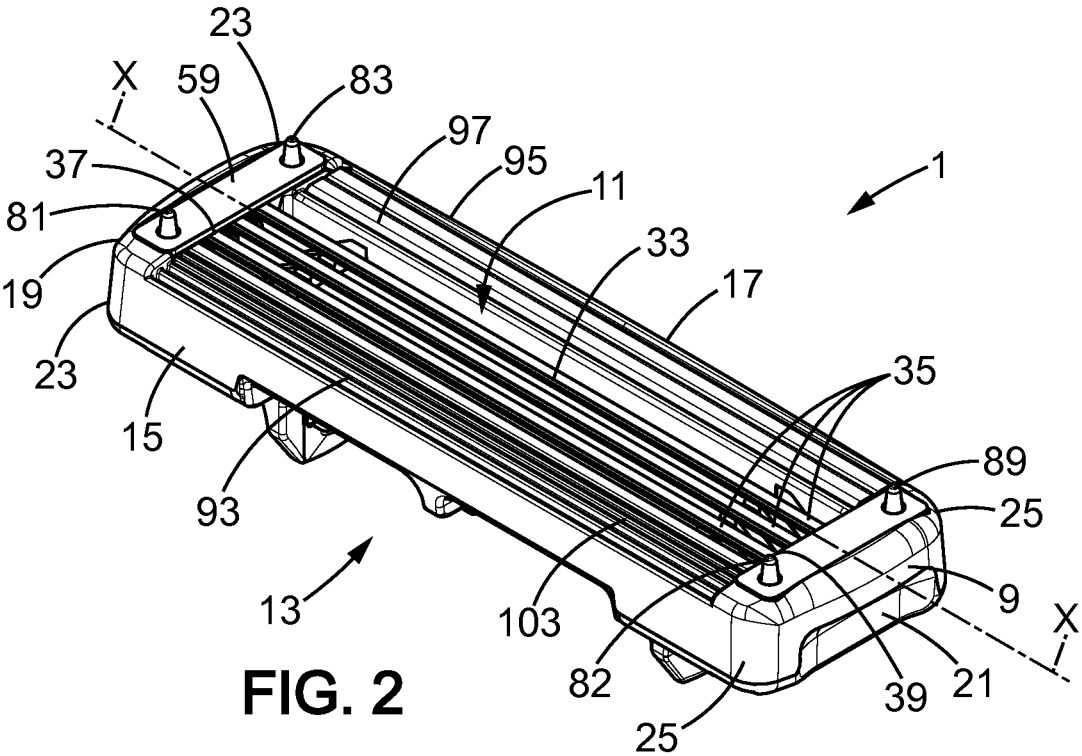
FIG. 2 shows the shaving blade cartridge of the FIG. 1 before the riveting operation.
Figure 4:
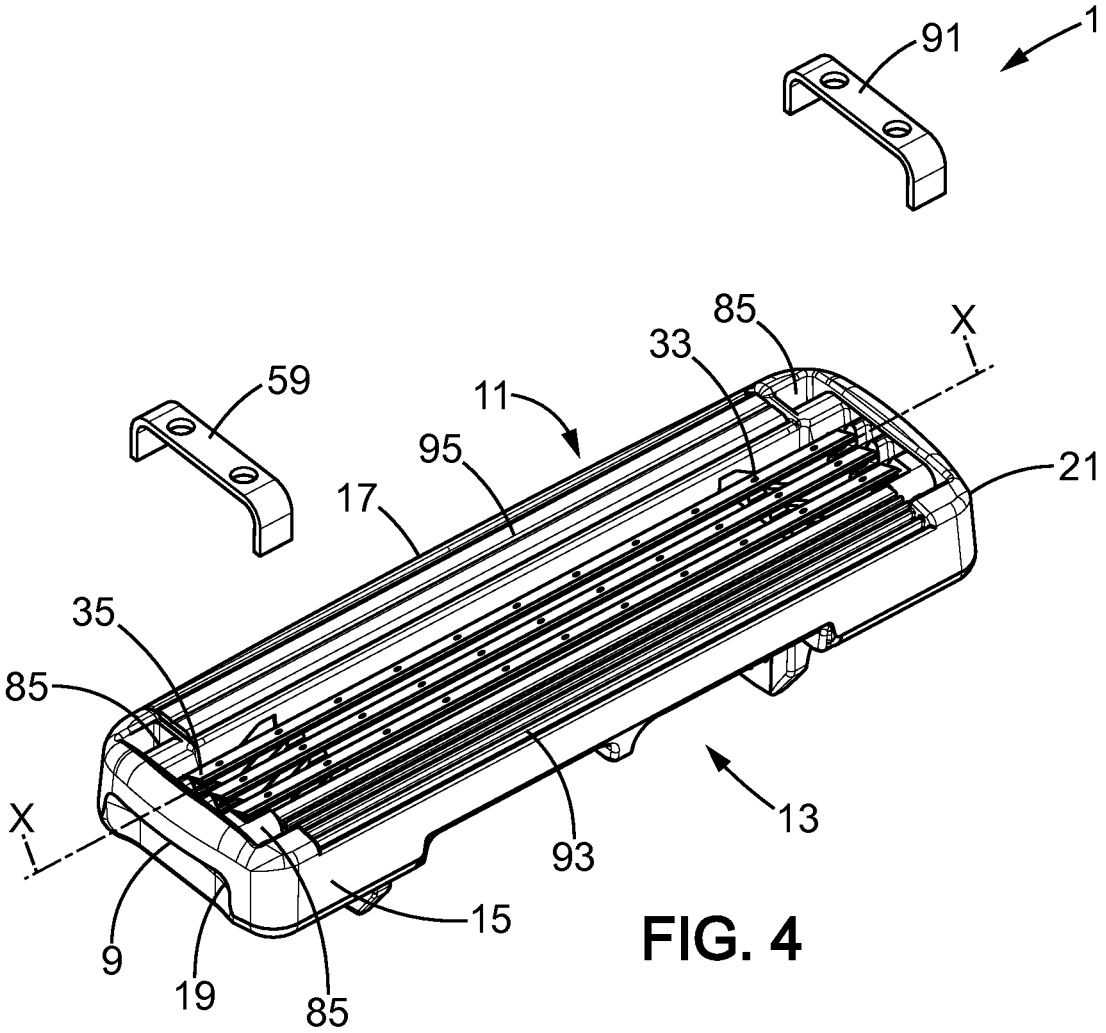
FIG. 4 is a perspective view of a shaving blade cartridge according to an embodiment of the present invention, in which the retainers each include two legs, and before the installation of the retainers on the housing.

The housing 9 may also include, as best seen in FIGS. 1, 2 and 4, first and second lateral sides 19, 21 which extend between the first and second longitudinal sides 15, 17, along a transversal axis Y-Y. The transversal axis Y-Y is transverse to the longitudinal axis X-X. The transversal axis Y-Y can be, for example, orthogonal to the longitudinal axis X-X and to the lateral axis Z-Z. The first and second lateral sides 19, 21 are arranged in the lateral direction Z between the top side 11 and the bottom side 13. The first and second lateral and longitudinal sides 15, 17, 19, 21 form together the external surface of the housing 9.

The first and second lateral sides 19, 21 both join the longitudinal ends 23, 25 of the first and second longitudinal sides 15, 17. In a similar way, the first and second longitudinal sides 15, 17 both join the free ends 27, 29 of the first and second lateral sides 19, 21. The housing 9 can include a plastic material. However, other materials could be used. For example, the housing could include a metallic material. Moreover, the housing can be made with a combination of two or more different materials. For example, a part of the housing may be made with a first material, whereas the other part of the housing is made with a second material.

The housing 9 can, for example, include, on the bottom side 13, a connection mechanism 31 adapted to connect the handle 7. The connection mechanism 31 can allow the release and/or the attachment of the shaving blade cartridge 1 to the handle 7.

The housing 9 also includes a blade receiving section 33, as represented in FIG. 2. The blade receiving section 33 or blade receiving area may have a generally rectangular shape. The blade receiving section 33 is arranged on the top side 11 of the housing 9. The blade receiving section 33 defines a recess and is adapted to receive at least one cutting blade 35. In other words, the shaving blade cartridge 1 includes at least one cutting blade 35 (also called blade in the rest of the description). As depicted in FIGS. 1, 2, 4, 5A, 5B, 8, and 11 the shaving blade cartridge can include three cutting blades. However, in other embodiments of the present invention, the shaving blade cartridge 1 can include more or less than three cutting blades 35. For example the shaving blade cartridge 1 can include five cutting blades.

The cutting blades 35 are mounted in the housing 9 in the blade receiving section 33 between the first and second longitudinal sides 15, 17 of the housing 9 and between the first and second lateral sides 19, 21 of the housing 9. As shown in FIGS. 1, 2 and 4 each blade 35 extends longitudinally along the longitudinal axis X-X. Each cutting blade 35 has a first and second end 37, 39 along the longitudinal axis X-X, and is directed toward the first longitudinal side 15. The first end 37 of the cutting blades 35 is directed toward the first lateral side 19 of the housing 9, whereas the second end 39 of the cutting blade 35 is directed toward the second lateral side 21 of the housing 9. Each cutting blade 35 includes a cutting edge 41. The cutting edge 41 extends along the longitudinal axis X-X. The cutting edge 41 of the cutting blade 35 is accessible at the top side 11 of the housing 9 to cut hair during shaving.

Figure 3:
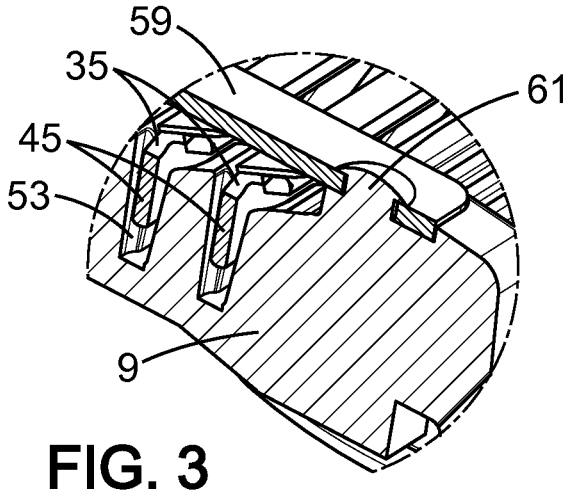
FIG. 3 shows a detailed view of a cross sectional of the rivet of FIG. 1.
Figure 5A:
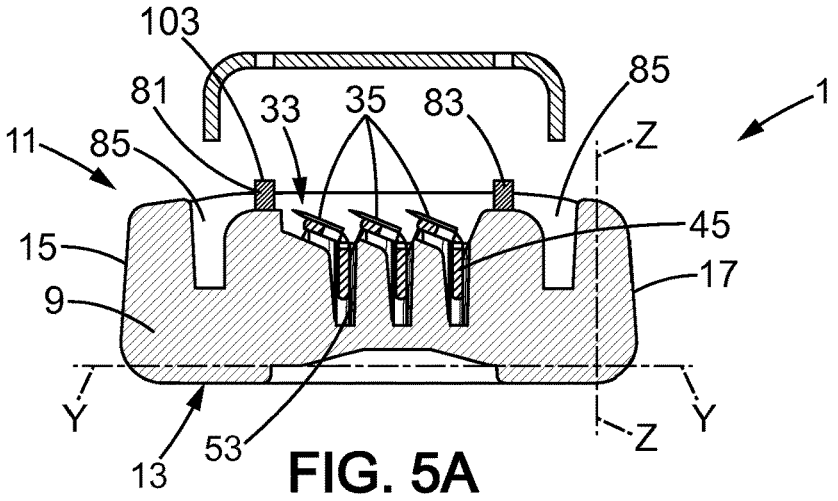
FIG. 5A is a cross sectional view of the shaving blade cartridge in FIG. 4, before the installation of the retainers on the housing.
Figure 5B:
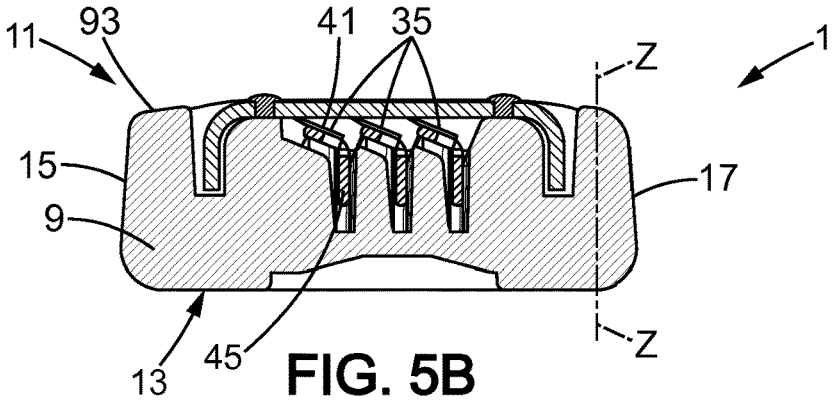
FIG. 5B is a cross sectional view of the shaving blade cartridge in FIG. 4, the retainers being mounted on the housing.

For example, the cutting blades 35 are substantially L-shaped as represented in FIGS. 3, 5A and 5B. The cutting blades 35 have a cutting edge portion 43, a guided portion 45, and a bent portion 47 which is intermediate to the cutting edge portion 43 and the guided portion 45. The cutting edge portion 43 extends along a cutting edge portion axis. Advantageously, the cutting edge portion axis of all cutting blades 35 are positioned parallel to each other.

In an embodiment of the present invention, each cutting blade 35 is freely mounted in the housing 9, as best seen in FIGS. 3, 5A and 5B. More precisely, the cutting blades 35 are movably mounted in the blade receiving section 33. Each cutting blade 35 is, for example, supported by two elastic fingers. The elastic fingers can be molded as a single piece with the housing 9 and can extend in the blade receiving section 33 towards each other and upwardly from both lateral sides 19, 21 of the housing 9. As shown in FIGS. 3, 5A and 5B, the guided portions 45 of the cutting blades 35 are slidingly guided in slots 53 provided in the housing 9. For example, the cutting blade 35 can be provided with its cutting edge 41 fixed on a blade support 57 which includes the guided portion 45 and the bent portion 47. In this case the blade support 57 is carried by the elastic fingers.

In others embodiments of the present invention (not shown on the figures) the blades can be bent blades, as described for instance in patent application WO2013/050606, or curved blades.

Each cutting blade 35 is retained in the housing 9 by a retainer 59. The retainer 59 is retained on the housing by a rivet 61. The rivet 61 is best represented in a cross-sectional view in the FIG. 3. The rivet 61 forms a permanent (non-detachable) mechanical fastener of the retainer on the housing 9.

Figure 6:
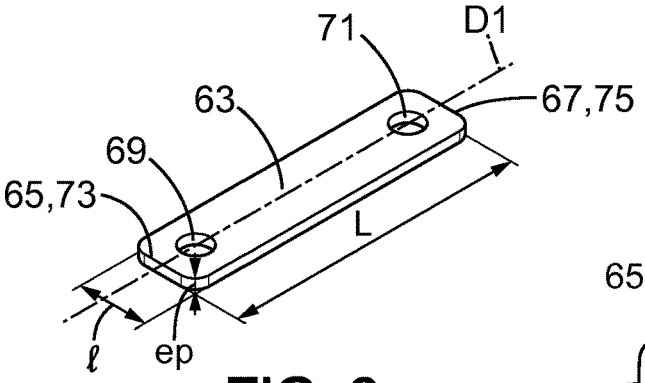
FIG. 6 shows a perspective view of the retainer of FIG. 1.
Figure 7:
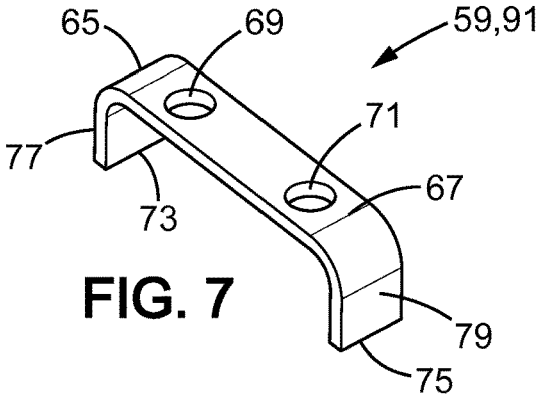
FIG. 7 shows a perspective view of the retainer of FIG. 4.

As represented in FIGS. 6 and 7, the retainer 61 includes a retainer body 63 which extends along a first direction D1. The retainer body 63 has a length "L", a width "l" and a thickness "ep". The width "l" of the retainer is substantially constant along its length "L". Moreover, as represented on FIGS. 6 and 7, the thickness "ep" of the retainer is substantially constant along its length "L". In others embodiments of the present invention, the width "l" and the thickness "ep" of the retainer can be variable.

The retainer body 63 has a first end 65 and a second end 67 along its length.

The retainer body 63 includes a first through hole 69 arranged toward its first end 65. The through hole 69 is located at a non-zero distance of the first end 65 of the retainer body 63. The through hole 69 has, for example a circular shape. However, other shapes can be provided. For example, the through hole may have a rectangular shape, a square shape, a L-shape, or an oval shape. The through hole 69 is, for example, cut in the retainer body 63. The through hole 69 can also be drilled, for example. In other embodiments of the present invention, the retainer 59 may be directly formed with the through hole 69.

In the embodiment of the present invention depicted on FIGS. 6 and 7, the retainer body 63 includes a second through hole 71 arranged toward its second end 67. The second through hole 71 is similar to the first through hole 69. However, in some embodiments of the present invention, the second through hole 71 can have a shape and/or dimensions which are different from those of the first through hole 69.

As represented in FIG. 6, in a first embodiment of the present invention, the retainer is for example a strip includes the retainer body 63. The retainer 59 is substantially flat. The retainer 59 extends along the first direction D1. The first and second ends 65, 67 of the retainer body 63 corresponds to first and second free ends of the retainer 73, 75.

In another embodiment of the present invention, as in FIG. 7 and in FIGS. 4, 5A and 5B, the retainer 59 has a first leg 77. The retainer body 63 is preferably flat. The retainer 59 can also have a second leg 79, and the retainer body 63 extends between the first and second leg 77, 79. More particularly, the first leg 77 extends from the first end 65 of the retainer body 63, and the second leg 79 extends from the second end 67 of the retainer body 63. The legs 77, 79 are bent with regard to the retainer body 63 and extend in along a direction substantially orthogonal to the first direction D1. In at least one example of the present invention, the retainer is integrally formed. The legs of the retainer 59 are adapted to be inserted in corresponding recesses provided in the housing.

For example, the retainer, such as represented in the FIGS. 6 and 7 is integrally formed. The retainer can be made of a formable material, for example a sheet of suitable metal. However, other materials may be considered. In another embodiment, the retainer can also be manufactured by injection molding. A polymer material (for example a reinforced polymer material) can be molded to form the retainer. The retainer can be coated or plated.

In the embodiment depicted on FIG. 7, the legs 77, 79 of the retainer can be bent. In the case that a polymer material (for example a reinforced polymer material) is molded to form the retainer, the retainer 59 can be pressed to reach its final form.

The retainer 59 is adapted to be mounted on the housing 9 and then fixed to the housing 9 by a rivet 61.

In a mounted position of the retainer on the housing, the retainer body extends along the transversal axis Y-Y. The retainer body 63 extends on the top side 11 of the housing 9. More particularly, the retainer 59 is arranged facing the cutting edge 41 of the cutting blade 35. The first end 65 of the retainer body 63 is directed toward the first longitudinal side 15, whereas the second end 67 of the retainer body 63 is directed toward the second longitudinal side 17.

The top side 11 of the housing 9 has a riveting pin 81 protruding from the top side 11 of the housing 9. The riveting pin 81 protrudes from the top side 11 of the housing 9, for example, along the lateral axis Z-Z in the opposite direction than the direction of the bottom side. The riveting pin 81 is, for example, made with the same material than the housing 9. For example, the housing 9 and the riveting pin 81 are integrally formed (unitary or mono-bloc). However, in some embodiments of the present invention, the riveting pin 81 can be made from a material different from the material of the housing 9. The riveting pin 81 can also be assembled to the housing 9, for example by welding, such as laser welding, or other assembly methods. The riveting pin 81 can have a conical shape. The conical shape facilitates the demoulding from an injection mould. However, the riveting pin 81 may have others shape, for example a cylindrical shape, or a spherical shape. The riveting pin 81 can be hollow or solid. For example, the riveting pin can be cylindrical and hollow (and can be referred to as a crimping pin).

The riveting pin 81 is located between the periphery of the blade receiving section 33 and the longitudinal and/or lateral sides 15, 17, 19, 21 of the housing 9. More precisely, the longitudinal sides 15, 17 each have a first and second end 85, 87, and the lateral sides 19, 21 each have a first and second end 23, 25. The first and second lateral sides 19, 21 both join the first and second ends 27, 29 of the first and second longitudinal sides 15, 17. In a similar way, the first and second longitudinal sides 15, 17 both join the first and second ends 27, 29 of the first and second lateral sides 19, 21. The riveting pin 81 is located near the first and/or second end 23, 25 of the first and/or second longitudinal side 15, 17 and/or near of the end 27, 29 of the first and/or second lateral side 19, 21.

As represented in FIGS. 1 and 2, the housing 9 can include a second riveting pin 83. For example, the first riveting pin 81 is located near the first end 23 of the first longitudinal side 15, and the second pin 83 is located near the first end 23 of the second longitudinal side 17. For example, the first and second riveting pins 81, 83 are located on either side of the cutting blade 35. The second riveting pin 83 is similar to the first riveting pin 81. However, in some embodiments of the present invention, the second riveting pin 83 can be different. For example, the second riveting pin 83 can have a different shape or different dimensions than the first riveting pin 81. The material of the second riveting pin 83 can be different from the material of the first riveting pin 81.

In a mounted position of the retainer 59 on the housing 9, the riveting pin 81, 83 cooperates with the through hole 69, 71 of the retainer 59. The shape of the through hole 69, 71 of the retainer 59 is complementary of the shape of the riveting pin 81, 83. As represented in FIGS. 6 and 7, the through hole 69, 71 has a circular cross section. The diameter of the through hole 69, 71 is substantially the same than the diameter of the riveting pin 81, 83.

For example, as represented in FIG. 2, in a mounted position, when the retainer 59 has two through holes 69, 71 and the housing 9 includes two riveting pins 81, 83 (the riveting pins being located on either sides of the cutting edge, for example), each of the through holes 69, 71 of the retainer 63 cooperates with one riveting pin 81, 83. The first through hole 69 is located toward the first free 73 end of the retainer 59, whereas the second through hole 71 is located toward the second free end 75 of the retainer 59. The first and second through holes 69, 71 are adapted to cooperate with the first and second riveting pins 81, 83 in order to form a first and second rivet 61.

In the embodiment of the present invention disclosed in the FIGS. 5A and 5B, in a mounted position of the retainer 59, each leg 77, 79 is received in a recess 85 provided on the housing 9. The recess 85 extends into the top side 11 of the housing 9. The recess 85 extends along the lateral axis Z-Z. The recess 85 is, for example, a blind hole. However, in other embodiments of the present invention, the recess 85 can be a through hole (for example, an aperture which passes through the housing from the top side of the housing to the bottom side of the housing and which is completely surrounded by material when viewed from the top side or from a cross-section).

The recess 85 can have different shapes. For example, the recess 85 can be square, rectangular, circular, oval, U-shaped or L-shaped.

The shape of the recess 85 can be complementary of the shape of the leg 77, 79 of the retainer 59. Viewed in a transverse section, the shape of the leg 77, 79 of the retainer 59 can be rectangular. The leg 77, 79 thus cooperates with a rectangular-shaped recess 85. The shape of the leg 77, 79 of the retainer 59 can also be oval when viewed in a transverse section, and the leg 77, 79 can cooperate with an oval-shaped recess 81. The leg 77, 79, when viewed in a transversal section, can be U-shaped with a base extending between two lateral parts. The leg 77, 79 can then be inserted in a recess 85, which is also U-shaped.

As represented in FIGS. 5A and 5B, the housing 9 has two recesses 85, each recess 85 being on either side of the cutting edge. However, in some embodiments of the present invention, the retainer 59 can be provided with only one leg 77, 79 and the housing 9 with only one recess 85.

The housing 9 may also include a third and a fourth riveting pin 87, 89. The four riveting pins 81, 83, 87, 89 can be arranged, as represented in FIG. 2, on the top side 11 at the four corners of the housing 9 when the housing has a rectangular shape, for example. The four riveting pins 81, 83, 87, 89 are similar. The four riveting pins 81, 83, 87, 89 have the same orientation, and project along the lateral axis Z-Z. The four riveting pins 81, 83, 87, 89 have the same shape, for example a conical shape. However, in some embodiments of the present invention, the four riveting pins 81, 83, 87, 89 may be different. For example, each riveting pin 81, 83, 87, 89 may have a different orientation, or a different shape, or can be of different materials.

Figure 8:
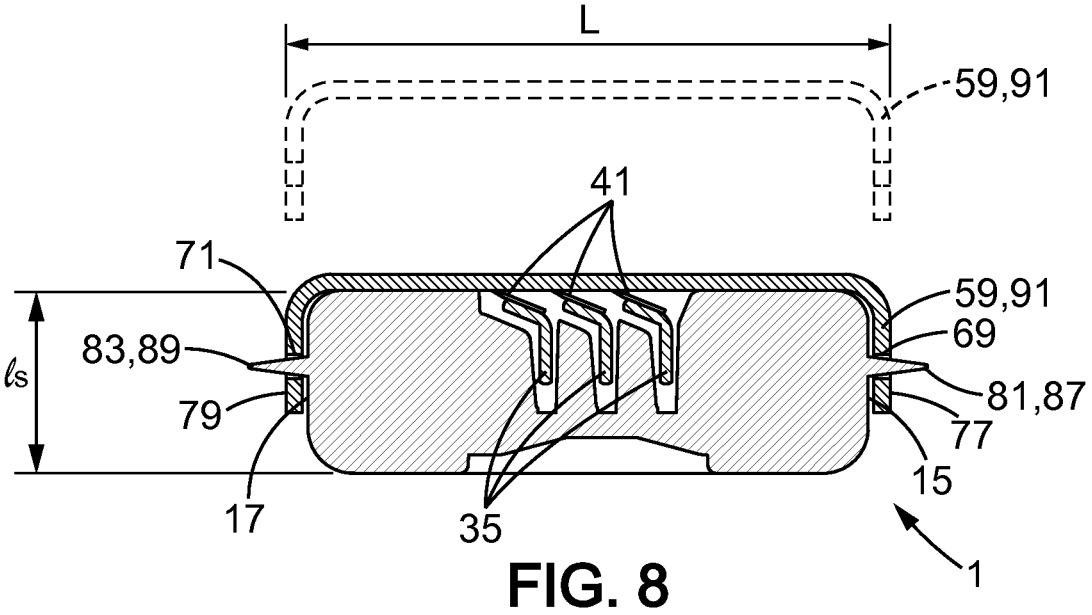
FIG. 8 shows a cross sectional view of a shaving blade cartridge according to an embodiment of the present invention.

In an alternate embodiment of the present invention, as depicted in FIG. 8, the riveting pin 81 is located on the first longitudinal side 15 of the housing 9. A second riveting pin 83 can be provided on the second longitudinal side 17. The riveting pin 81, 83 can protrude form the first/second longitudinal side 15, 17 along a direction which is orthogonal to the longitudinal axis X-X. For example, the riveting pin 81, 83 can protrude along the transversal axis Y-Y. The longitudinal side 15, 17 can have a width "ls" along the lateral axis Z-Z. The riveting pin can be located midway between the top side 11 of the housing 9 and the bottom side 13 of the housing 9.

In the embodiment of the present invention represented in FIG. 8, the retainer 59 includes a first leg 77, a second leg 79 and a retainer body 63 which extends between the first and second legs 77, 79. The retainer 59 in the embodiment of the FIG. 8 has a shape which is similar to the shape of the retainer 59 depicted on FIGS. 5A, 5B and 7. However, the position of the through holes 69, 71 is different. In order to cooperate with the riveting pins 81, 83 provided on the longitudinal sides 15, 17, the first through hole 69 and the second through hole 71 of the retainer 59 in the embodiment of FIG. 8 are provided on the first leg 77 and on the second leg 79 of the retainer 59. The first through hole 69 and/or the second through hole 71 are substantially in the middle of the first leg 77 and/or the second leg 79.

Figure 10:
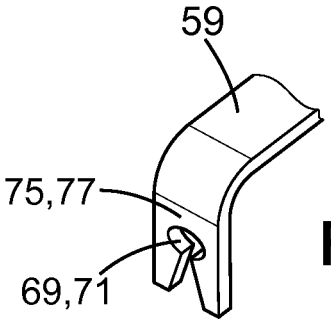
FIG. 10 represents a leg of a retainer having a through hole according to an embodiment of the present invention.

FIG. 10 represents an embodiment of the through hole 69, 71 of the retainer 59 depicted on FIG. 8. The through hole 69, 71 of the leg 77, 79 of the retainer 59 is at a non-zero distance of the free end of the leg 77, 79. The through hole 69, 71 is opened toward the free end of the leg 77, 79 of the retainer 59 in order to facilitate the mounting of the retainer 59 on the housing, and the insertion of the riveting pin into the through hole 69, 71. In other words, a channel 105 is provided from the free end of the leg of the retainer to the through hole.

The channel 105 communicates with the through hole 69, 71 and extends until the free end of the leg 75, 77 of the retainer 59. The channel may have a triangular shape, with an enlarged aperture toward the free end of the leg of the retainer, and a small aperture toward the through hole. By mounting the retainer 59, the legs 77, 79 of the retainer 59 surround the housing 9, and more precisely surround the longitudinal sides 15, 17 of the housing, such that the first leg 77 of the retainer 59 surrounds the first longitudinal side 15 and the second leg 79 of the retainer surrounds the second longitudinal side 17.

As best shown in FIG. 1 or 2, the cutting blades can be retained in the housing by two retainers 59, 91. The retainers 59, 91 can be the same, as represented in FIG. 2 or in FIGS. 4, 5A, 5B. However, in some embodiments of the present invention, the retainers 59, 91 may be different. For example, the shape, dimension and/or materials of the retainers 59, 91 could be different. The two retainers 59, 91 may each have two through holes 69, 71, which each cooperate with a riveting pin 81, 83 provided on the housing 9. For example, the two through holes 69, 71 of the first retainer 59 cooperate with the first and second riveting pin 81, 83, whereas the two through hole 69, 71 of the second retainer 91 cooperate with the third and the fourth riveting pin 87, 89. Thus, the two retainers 59, 91 are provided toward the first and second end 37, 39 of the cutting blade 35. The retainers 59, 91 are located above the cutting edge 41 to retain the cutting blades 35 in the housing 9 and have a position which avoids an important reduction of the shaving area. Moreover, in at least one embodiment of the present invention, a first retainer 59 can be flat such as represented in the FIG. 6, whereas the second retainer 91 has two legs 77, 79 and a retainer body 63 extending between the two legs, the two legs being received in recesses 85 of the housing 9.

The shaving blade cartridge 1 can include a guard bar 93, which is provided on the housing 9. The guard bar 93 is forward of the cutting edge 41. The riveting pin 81, 83 can be adjacent to the guard bar 93.

The housing 9 can also include a rear cap 95, which can be provided with a shaving aid member 97. The shaving aid member 97 is rearward of the cutting edge 41. The riveting pin(s) 81, 83 can be provided adjacent to the shaving aid member 97.

For example, in the embodiment depicted in the FIGS. 1, 2, 4, 5A, 5B with four riveting pins 81, 83, 87, 89 and two retainers 59, 91, two riveting pins can be adjacent to the shaving aid member 97 whereas two riveting pins are adjacent to the guard bar 93. In another embodiment with a housing 9 includes two riveting pins 81, 83, the first riveting pin can be arranged adjacent to the guard bar 93, whereas the second riveting pin is arranged adjacent to the shaving aid member 97.

In an embodiment of the present invention, a riveting pin can be located mid-way between the first and second longitudinal sides 15, 17. The riveting pin can be adapted to cooperate with a through hole provided on the middle of the retainer body 63.

In the embodiment of the present invention as shown in FIG. 8, the housing can be provided with four riveting pins. For example, two riveting pins 81, 87 are located on the first longitudinal side 15, and two riveting pins 83, 89 are located on the second longitudinal side 17. The first riveting pin 81 on the first longitudinal side 15 and the second riveting pin 83 on the second longitudinal side 17 can be located toward the first lateral side 19 whereas the third riveting pin 87 on the first longitudinal side 15 and the fourth riveting pin 89 on the second longitudinal side 17 are located toward the second lateral side 21.

In order to assemble the retainer 59, 91 to the housing 9 and to fix (attach without release) the retainer 59, 91 onto the housing 9, the retainer 59, 91 will be in a first step placed in front of the top side 11 of the housing 9.

In the embodiment of FIG. 8, by mounting the retainer 59, 91, an operator (or an assembly machine) translates the retainer 59, 91 along the lateral axis Z-Z in the direction of the bottom side 13. The free end of the leg 77, 79 of the retainer 59, 91 translates along the longitudinal side 15, 17 toward the riveting pin 81, 83, 87, 89. The retainer 59, 91 is then further translated such that the riveting pin is moved 81, 83, 87, 89 in the channel 105 from the free end of the leg 75, 77 to the through hole 69, 71. When the riveting pin 81, 83, 87, 89 is received in the through hole 69, 71, the riveting pin 81, 83, 87, 89 is in its mounted position. In order to fasten the retainer on the housing 9, the riveting pin is deformed to form a rivet, as visible in FIG. 9.

The retainer 59, 91 is then mounted on the housing 9 by cooperation of the riveting pin 81, 83, 87, 89 with the through hole 69, 71 of the retainer 59, 91. The internal surface 99 of the retainer body 63 is in front of the top side 11 of the housing 9. The external surface 101 of the retainer body 63 is located opposite to the internal surface 99. For example, slots may be provided on the housing to receive the retainer 59, 91, such that the retainer 59, 91 does not protrude from the top side 11 of the housing 9. When the retainer 59, 91 is mounted on the housing 9, the riveting pin 81, 83, 87, 89 protrudes from the retainer 59, 91. More precisely, the length of the riveting pin 81, 83, 87, 89 along the lateral axis Z-Z, for the embodiments depicted in FIGS. 1, 2, 4, 5A and 5B, or along the transversal axis Y-Y for the embodiment depicted in FIG. 8 is greater than the thickness "ep" of the retainer 59, 91.

The retainer 59, 91 is then fixed to the housing 9 by deforming the end of the riveting pin 81, 83, 87, 89 such that the dimension of the end of the riveting pin 81, 83, 87, 89 is bigger than the dimension of the through hole 69, 71, and the retainer 59, 91 cannot move away from the housing 9. In other words, the free end 103 of the riveting pin 81, 83, 87, 89 is plastically deformed (or upset, or buckled), such that the riveting pin 81, 83, 87, 89 deforms with regard to its original shape on the external surface 101 of the retainer 59, 91. The deformation of the riveting pin 81, 83, 87, 89 allows the retainer 59, 91 to be held in place. The retainer 59, 91 is sandwiched between the deformed portion of the riveting pin 81, 83, 87, 89 and the housing 9. For example, the riveting pin can be hollow. In this case, the riveting may be assimilated to a crimping.

The deformation is realized by punching the free end of the riveting pins 81, 83, 87, 89. The punching of the free end of the riveting pins 81, 83, 87, 89 introduces a plastic deformation of the riveting end.

The deformation can also be realized by applying an ultrasonic beam to the riveting pin 81, 83, 87, 89, and more particularly to the free end 103 of the riveting pin 81, 83, 87, 89. For example, a sonotrode (not illustrated) serves to transmit the ultrasonic beam. By applying an ultrasonic beam, a riveting melting deformation of the free end 103 of the riveting pin 81, 83, 87, 89 occurs. The rivet 61 can be obtained by other methods than ultrasonic riveting. The rivet 61 is then fixedly fastened. The same sonotrode can carry out several simultaneous riveting. For example, in the embodiment of the present invention depicted in the FIGS. 1, 2, 4, 5A, 5B with two retainers 59, 91 and two riveting pins 81, 83, 87, 89 per retainer 59, 91, the same sonotrode can carry out the riveting of the four rivets 61 simultaneously.

Figure 9:
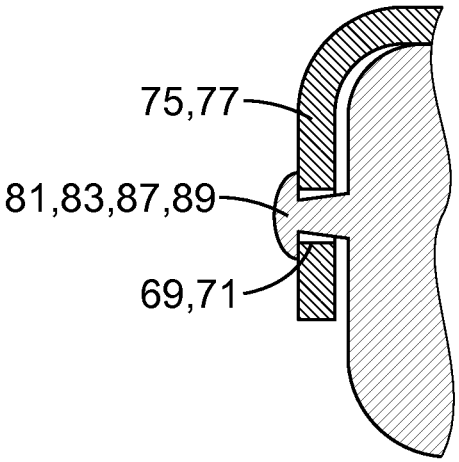
FIG. 9 shows a detailed view of the rivet in the FIG. 8 after riveting operation.

After the plastic deformation of the riveting pin 81, 83, 87, 89, the rivet 61 is formed and the retainer 59, 91 is held in place by the rivet 61, as represented in FIGS. 3 and 9. For example, the housing 9 has recesses to receive the rivet 61 such that the rivet 61 does not protrude from the housing 9. The rivet 61 can be flush with the sides 15, 17, 11 of the housing 9. In the embodiments of FIGS. 1, 2, 3, 4, 5A, 5B the rivet 61 can be flush with the top side 11 of the housing 9. In the embodiment of FIG. 8, the rivet 61 can be flush with the longitudinal side 15, 17 of the housing. The design of the housing 9 and more precisely of the area which receives the rivet 61 can also be such that the rivet 61 is below the sides 15, 17, 11 of the housing 9.

The portions of the retainer 59, 91 in front of the cutting blade retain the cutting blade 35. The portion of retainer 59, 91 in front of the cutting blade 35 can touch the cutting blade 35 when the blades are in a rest-position (i.e. when no external force is applied to the shaving blade cartridge). For example, the retainer 59, 91 can be made with an aluminum alloy material. The blade 35 can be made with a steel alloy material. The different materials between the blade and retainer enhance cathodic protection and blade longevity.

In addition, the retainer 59, 91 can be made with an aluminum alloy material. The cutting blade 35 can be made with a steel alloy material. The different materials between the blade and retainer enhance cathodic protection and cutting blade longevity.

The invention claimed is:

1. A shaving blade cartridge comprising:

a housing extending along a longitudinal axis, the housing having a top side, a bottom side opposite to the top side, and two longitudinal sides extending along the longitudinal axis between the top and bottom sides, the top, bottom and two longitudinal sides forming an outermost external surface of the shaving blade cartridge;

a cutting blade mounted in the housing between the longitudinal sides, and having a cutting edge extending along the longitudinal axis; and a retainer retaining the cutting blade in the housing, the retainer includes a retainer body disposed above the cutting edge and at least one leg extending therefrom, the retainer body having at least one through hole;

wherein the retainer is retained to the housing by the at least one leg being received in at least one recess formed in the housing and by at least two rivets extending from the outermost external surface of the housing through the at least one through hole formed in the retainer body; and wherein at least one of the two riveting pins is located in front of the cutting edge and the other of the at least two riveting pins is located rear of the cutting edge.

2. The shaving blade cartridge according to claim 1, wherein the retainer body extending along the top side of the housing, and the retainer and the housing are joined together on the top side of the housing, the top side of the housing being closest to the cutting blade.

3. The shaving blade cartridge according to claim 1, wherein the at least one through hole includes two through holes, each one of the two through holes cooperates, respectively, with one of the two riveting pins.

4. The shaving blade cartridge according to claim 1, wherein the at least one riveting pin comprises a plastic material.

5. The shaving blade cartridge according to claim 1, wherein the housing is provided with a guard bar, the guard bar being forward of the cutting edge, and wherein the at least one riveting pin is provided adjacent to the guard bar.

6. The shaving blade cartridge according to claim 1, wherein the housing includes a shaving aid member, the shaving aid member being rearward of the cutting edge, and wherein the at least one riveting pin is provided adjacent to the shaving aid member.

7. The shaving blade cartridge according to claim 1, wherein the at least one riveting pin and the housing are made of the same material.

8. The shaving blade cartridge according to claim 1, wherein the retainer body extends along a transversal axis, the transversal axis being transverse to the longitudinal axis, the retainer body including two free ends, the at least one through hole being located proximate to at least one of the two free ends.

9. The shaving blade cartridge according to claim 1, wherein the retainer body is a flat strip having a first end and a second end, the first end and the second end corresponding to a first free end and a second free end of the retainer, the at least one leg extending from one of the first or the second free ends.

10. The shaving blade cartridge according to claim 1, wherein the at least one recess includes two recesses, and the at least one leg includes two legs, the retainer body extending between the two legs and extending along a transversal axis, the transversal axis being transverse to the longitudinal axis, and the two legs are each received in one of the two recesses.

11. The shaving blade cartridge according to claim 10, wherein the two recesses extend along a lateral axis intersecting the transversal axis and the longitudinal axis, and the two recesses are blind holes, one of the two recesses is located frontward of the cutting blade and the other of the two recesses is located rearward of the cutting blade.

12. The shaving blade cartridge according to claim 1, wherein the shaving blade cartridge further includes two retainers retaining the cutting blade on the housing, the at least one recess formed through the housing includes two recesses, the at least one rivet includes at least two rivets, and the at least one leg includes at least two legs such that each one of the two retainers includes two legs, each one of the two retainers are joined to the housing by at least one of the, respective, at least two rivets on the top side of the housing and by at least one of each of the, respective, at least two legs.

13. A shaver comprising a handle and a shaving blade cartridge according to claim 1, the shaving blade cartridge being connected to the handle.

14. A shaving blade cartridge comprising:

a housing extending along a longitudinal axis, the housing having a top side, a bottom side opposite to the top side, and two longitudinal sides extending along the longitudinal axis between the top and bottom sides, the top, bottom and two longitudinal sides forming an outermost external surface of the shaving blade cartridge;

a cutting blade mounted in the housing between the longitudinal sides, and having a cutting edge extending along the longitudinal axis; and a retainer retaining the cutting blade in the housing, the retainer including a retainer body having two through holes and having at least one leg extending therefrom;

wherein the retainer is retained to the housing, above the cutting blade, by a rivet extending from the outermost external surface and the at least one leg received in a recess formed in the housing, and the rivet includes two riveting pins, each one of the two through holes cooperates with a respective one of the two riveting pins, and wherein one of the two riveting pins is located in front of the cutting edge and the other of the two riveting pins is located rear of the cutting edge.

15. The shaving blade cartridge according to claim 14, wherein the at least one recess includes two recesses and the at least one leg includes two legs, the retainer body extends between the two legs and extends along a transversal axis, the transversal axis being transverse to the longitudinal axis, and the two legs are each received in a respective one of the two recesses.

16. The shaving blade cartridge according to claim 15, wherein the two recesses extend along a lateral axis intersecting the transversal axis and the longitudinal axis, the two recesses are blind holes, and one of the two recesses is located frontward of the cutting blade and the other of the two recesses is located rearward of the cutting blade.

17. A shaving blade cartridge comprising:

a housing extending along a longitudinal axis, the housing having a top side, a bottom side opposite to the top side, and two longitudinal sides extending along the longitudinal axis between the top and bottom sides, the top, bottom and two longitudinal sides forming an outermost external surface of the shaving blade cartridge;

a cutting blade mounted in the housing between the longitudinal sides, and having a cutting edge extending along the longitudinal axis; and a retainer including a retainer body having a through hole and having at least one leg extending therefrom, the retainer extending above the cutting blade and retaining the cutting blade in the housing, wherein the retainer is retained to the housing by at least two rivets extending from the outermost external surface and the at least one leg received in a recess formed in the housing, and wherein the shaving blade cartridge includes two retainers retaining the cutting blade on the housing, each of the two retainers and the housing are joined together, respectively, by at least one of the at least two rivets, the at least two rivets being formed on the top side of the housing, and extends through the through hole formed in the body of the retainer wherein one of the at least two riveting pins is located in front of the cutting edge and the other of the two riveting pins is located rear of the cutting edge.

* * * * *